United States Patent [19]

Erickson

[11] 4,444,390

[45] Apr. 24, 1984

[54] HYDRAULIC EXERCISING DEVICE

[76] Inventor: David T. Erickson, 18001 Hwy. 7, Suite 200, Minnetonka, Minn. 55343

[21] Appl. No.: 415,145

[22] Filed: Sep. 7, 1982

Related U.S. Application Data

[63] Continuation-in-part of Ser. No. 208,659, Nov. 20, 1980, Pat. No. 4,363,481.

[51] Int. Cl.[3] ..... A63B 21/00

[52] U.S. Cl. ..... 272/130; 272/134

[58] Field of Search ..... 272/72, 130, 134, 129, 272/125, 117, 128; 128/25 R

[56] References Cited

U.S. PATENT DOCUMENTS

| | | | |
|---|---|---|---|
| 445,726 | 2/1891 | Coop | 272/72 |
| 927,833 | 7/1909 | Cunningham | 272/72 |
| 1,598,940 | 9/1926 | Smith | 272/72 |
| 1,966,848 | 7/1934 | Charters | 272/72 |
| 2,278,591 | 4/1942 | Sak | 272/72 |
| 2,777,439 | 1/1957 | Tuttle | 128/25 R |
| 3,266,801 | 8/1966 | Johnson | 272/72 |
| 3,369,403 | 2/1968 | Carlin | 272/130 |
| 3,387,843 | 6/1968 | Chandler | 272/130 |
| 3,606,318 | 9/1971 | Gilstrap | 272/72 |
| 4,138,106 | 2/1979 | Bradley | 272/129 |
| 4,226,415 | 10/1980 | Wright | 272/130 |
| 4,227,689 | 10/1980 | Keiser | 272/134 |
| 4,235,437 | 11/1980 | Ruis et al. | 272/130 X |
| 4,239,210 | 12/1980 | Lambert | 272/118 |
| 4,257,593 | 3/1981 | Keiser | 272/130 |

*Primary Examiner*—Richard J. Johnson

*Attorney, Agent, or Firm*—Burd, Bartz & Gutenkauf

[57] ABSTRACT

An exercise device of the weight lifting type wherein the force or load conventionally supplied by weights is effectively simulated by fluid means such as a hydraulic assembly. One or more hydraulic assemblies act upon a reaction bar to tend to move it one direction. The exercising person engages the reaction bar and exerts force upon it in the direction opposite to the force exerted by the hydraulic assemblies. Force is exerted in a direction opposite to the direction of the force exerted by the hydraulic assembly in both in an extension and retraction phase of the exerciser's routine.

10 Claims, 12 Drawing Figures

V REF

V RED
V RED
V
V
V

HYDRAULIC EXERCISING DEVICE

CROSS REFERENCE TO RELATED APPLICATION

This application is a continuation-in-part of application Ser. No. 208,659 filed Nov. 20, 1980 now U.S. Pat. No. 4,363,481.

SUMMARY OF THE INVENTION

The invention pertains to an exercise device to exercise muscles of the human body by working against force provided by hydraulic means to simulate weight lifting exercises. As a beneficial form of exercise and muscle building and toning, weight lifting is a popular sport. Various types of weights are lifted by numerous ways in order to exercise, build and maintain different muscles. Not only are dead weight devices such as barbells used in weight lifting, in addition machines are provided whereby weights are moved or lifted through an arrangement of pulleys, levers and the like by the exercising person's exertion of muscular power primarily through the arms or legs while in a standing, sitting or lying position. The exercising person typically goes through an exercising routine comprised of sequential extension and retraction of the limbs. In performing a weight lifting sequence, the exerciser extends the limbs against the resistance of the force provided by one or more weights, and then retracts the limbs again under the same force of the weights. The force of the weights is the same during extension and retraction phases of the sequence. However, most muscle groups used in weight lifting procedures are capable of sustaining a greater force or load during the retraction phase of the sequence than the extension phase. With conventional weights and weight systems, the upper limit of the amount of weight to be lifted during the exercise routine is dictated by the muscular capability of the exerciser during the extension phase of the sequence.

The present invention relates to a weight lifting type of exercise device wherein the force or load conventionally supplied by weights is provided by fluid powered means. One or more hydraulic actuators comprised as cylinder assemblies have a piston and rod moveably assembled with respect to a cylinder whereby the rod is extendable and retractable with respect to the cylinder under the influence of a preselectable amount of force. One part of the assembly is pivotally connected to a frame. The other part of the assembly is connected to a moveable reaction bar or weight bar connected to the frame to be engaged by the exercising person. The exercising person engages the reaction bar and exerts force upon it in a direction opposite to the force exerted by the cylinder assemblies. The exercising person exerts force on the weight bar in a direction resisting movement of the rod with respect to the cylinder. In the extension phase of the exercise routine, the exerciser moves the weight bar in a direction opposite that of the force applied by the cylinder assemblies. In the retraction phase, or let-down phase, the exerciser permits movement of the weight bar in the same direction as the force is applied by the cylinder assemblies, but resists somewhat as though a weight were being "let-down". In a preferred embodiment, means are provided whereby the force supplied by the cylinder assemblies is greater during the retraction phase of the sequence to permit optimum usage of muscle groups which are able to accommodate a greater force during a retraction phase than in an extension phase. The force supplied by the cylinder assembly to be resisted by the exercising person is controlled by a relief valve. In a preferred embodiment, first and second relief valves are provided for selectively controlling the amount of force supplied by the cylinder assemblies. During the extension phase of the exercise sequence, a first of these relief valves is operative to cause a first force to be supplied to the cylinder assemblies. At the outermost limit of the extension phase, a switch is actuated whereby the second relief valve is operative to cause a second force to be supplied to the cylinder assemblies.

IN THE DRAWINGS

DESCRIPTION OF A PREFERRED EMBODIMENT

Figures 1, 2, 7, 8, 8A:
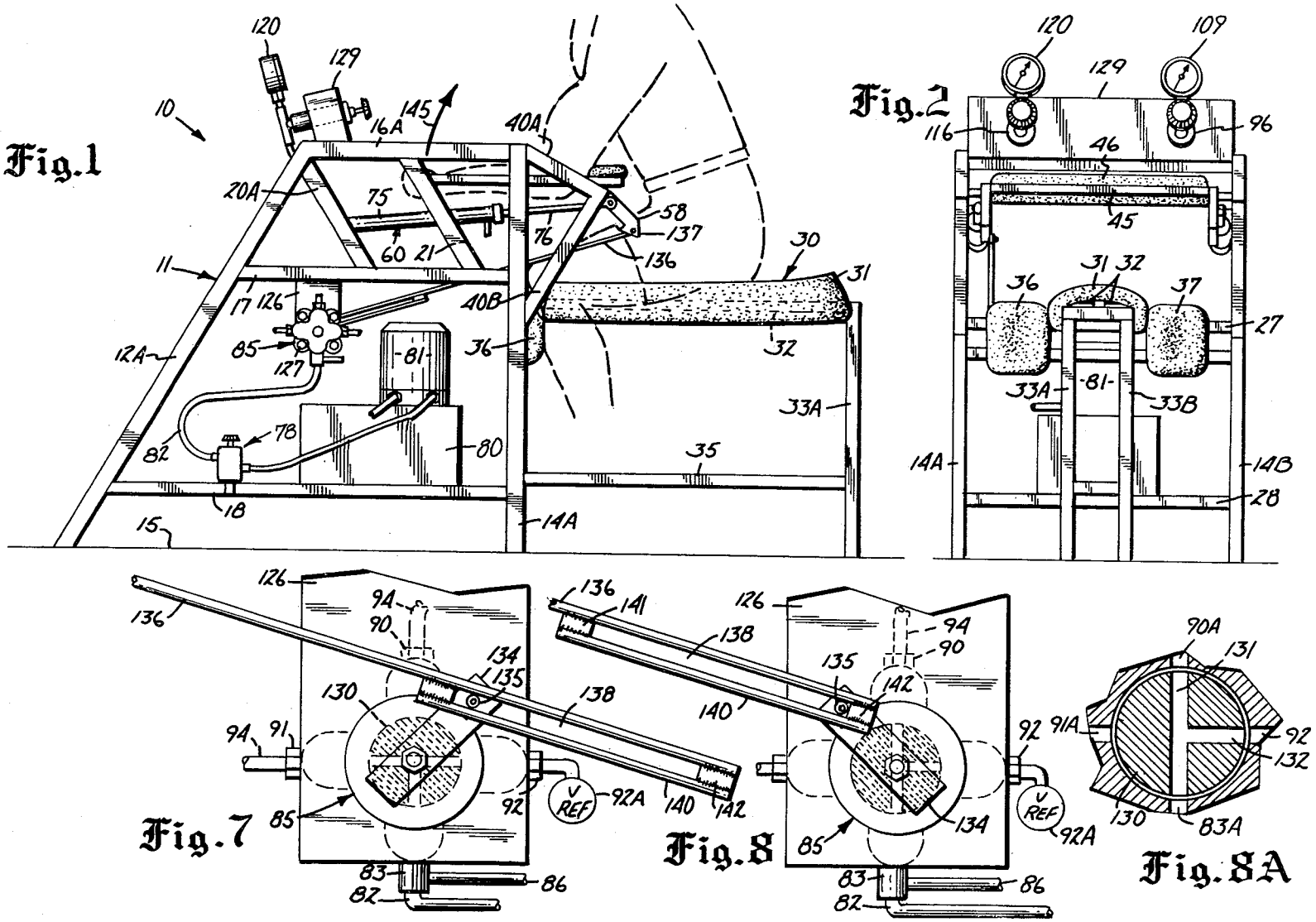
FIG. 1 is a side elevational view of an exercise device according to the invention with an exercising person at work thereon shown in phantom.
FIG. 2 is a rear elevational view of the exercise device of FIG. 1.
FIG. 7 is an enlarged view partly in section of the hydraulic directional control valve of the exercising device of FIG. 3 taken along the line 7—7 thereof.
FIG. 8 is another view of the hydraulic directional control valve like that shown in FIG. 7 but with the directional control valve moved to a second position.
FIG. 8A is an enlarged view in section of the spool of the valve of FIGS. 7 and 8.

Referring to the drawings, there is shown in FIGS. 1 and 2 one form of an exercise device of the present invention indicated generally at 10. Exercise device 10 includes a frame 11 having generally upright and slightly rearwardly inclined forward legs 12A, 12B, and generally upright rear legs 14A, 14B which support the frame 11 relative to a floor type surface 15. Longitudinal upper, intermediate and lower side frame members 16, 17, 18 respectively extend between the front and rear legs 12, 14 on each side of frame 11. Diagonal struts or brace members 20, 21 are provided on each side of frame 11 extended between the upper longitudinal frame member 16 and the intermediate longitudinal frame member 17. Forward and rearward transverse brace members 22, 23 extend horizontally between the lower longitudinal side frame members 18. Horizontal transverse front leg brace members 25, 26 extend between the front legs 12A, 12B of frame 11, and transverse upper and lower horizontal rear leg brace members 27, 28 extend between the rear legs 14A, 14B.

A seat assembly 30 is assembled to the rear of frame 11 and includes a padded seat cushion 31 mounted on horizontal, longitudinal seat support members 32. Seat support members 32 are rearwardly supported by seat legs 33A, 33B. The forward ends of seat support members 32 are connected to upper transverse rear leg brace member 27. Seat leg brace members 35 extend from the lower ends of seat legs 33A, 33B forwardly to a point of engagement with the forward transverse rear frame leg brace 28.

Knee pads 36, 37 are fastened to the upper transverse rear leg brace 27 in straddling relationship to the seat cushion 31 for padded support of the knees of an exercising person situated on the seat 31.

A force bar or handle bar assembly 39 is pivotally assembled to frame 11 for engagement and movement by an exercising person. A first handle bar assembly mounting bracket is fixed to a rear frame leg 14A and includes a first support member 40A extended from the upper end of the rear leg 14A rearwardly and slightly inclined downwardly therefrom. A second support member 40B extends from the rearward end of the first support member 40A downwardly and inwardly to an intermediate location on the rear leg 14A forming a triangularly shaped support bracket. In similar fashion, a second handle bar assembly mounting bracket is fixed to the other rear leg 14B and includes a first support member 41A extended from the upper end of the rear leg 14B rearwardly and slightly downwardly therefrom. A second support member 41B extends from the outer end of first support member 41A downwardly and forwardly therefrom to an intermediate location on the second rear frame leg 14B also to form a triangularly shaped support bracket.

Figure 5:
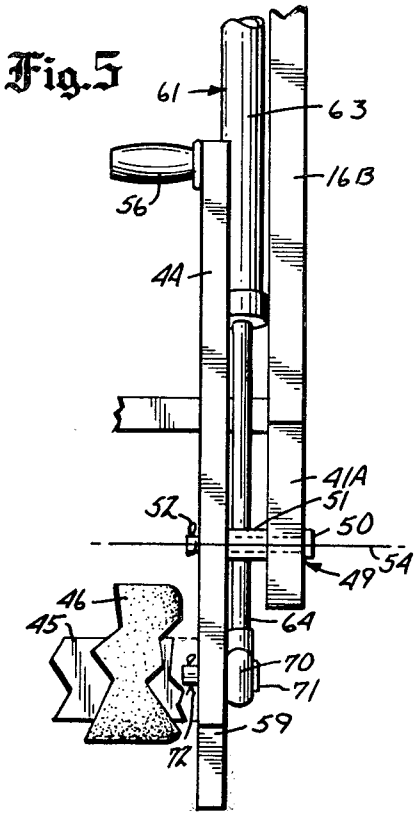
FIG. 5 is an enlarged top fragmentary view of a portion of the exercising device of FIG. 4.

Handle bar assembly 39 is generally U-shaped and includes a first elongate longitudinal force arm 43 and a second parallel, longitudinal force arm 44 spaced from the first force arm 43. The rearward ends of the force arms 43, 44 are connected by a transverse horizontal bar 45 by suitable means such as welding. A padded arm cushion 46 covers the upper and forward sides of transverse bar 45. First force arm 43 is pivotally connected toward its rearward end to the upper bracket member 40A by suitable pivot means 48. In like fashion, second force arm 44 is pivotally connected to bracket support 41A towards its rearward end by a suitable pivot 49. As shown in FIG. 5 pivot 49 can be comprised of a pin 50 having a head at one end and a shank extended through the bracket support member 41A and through a spacer 51 disposed between the bracket 41A and the second force arm 44, then extending through an opening provided in the second force arm 44. A cotter pin 52 is engaged in the interior end of the shank of the pin 50 to secure it relative to the bracket member 41A and the second force arm 44. The first and second pivots 48, 49 are transversely aligned so that the first and second force arms 43, 44 pivot about a transverse axis relative to the frame 11 and indicated at 54 in FIG. 5.

First force arm 43 extends forward of the pivotal axis 54 and terminates in an inwardly extended transverse handle 55. Likewise, second force arm 44 extends forward from the pivotal axis 54 and terminates in an inwardly extended handle 56. Handle 55, 56 are symmetrically orientated and are adapted to be grasped by the hands of an exercising person situated on the seat 31 with arms resting on cushion 46 on transverse bar 45. Transverse bar 45 is located rearwardly of the pivotal axis 54 with respect to handles 55, 56.

A first crank arm 58 extends rearwardly from the rearward end of the first force arm 43, and slightly downwardly, on the opposite side of the pivotal axis 54 with respect to handle 55. A second crank arm 59 extends rearwardly downwardly from the rear end of the second force arm 44 on the side of pivotal axis 54 opposite handle 56. A fluid motor assembly is connected to the first and second crank arms, 58, 59 in such a fashion to exert force on them to rotate the force arms 43, 44 and consequently the handles 55, 56 in a downward direction as viewed in FIGS. 1 and 3. The exercising person first exerts force on the handles 55, 56 in an upward direction lifting force arms 53, 56 about pivotal axis 54. Upon reaching an upper limit of travel, the exercising person lets the handles down while resisting movement against the force provided by the hydraulic motor assembly.

Figure 4:
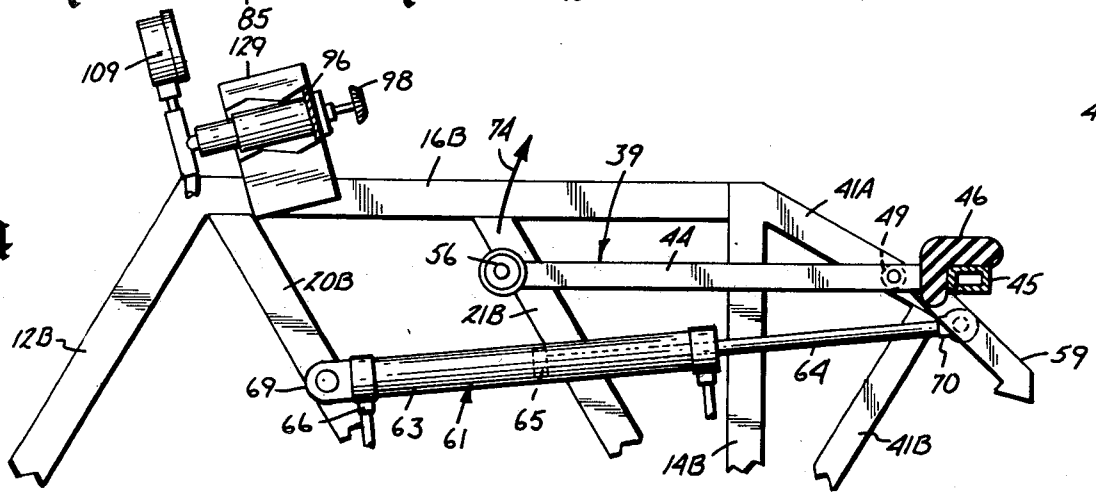
FIG. 4 is an enlarged sectional view of the exercising device of FIG. 3 taken along the line 4—4 thereof.

The fluid motor assembly includes first and second linear hydraulic actuators 60, 61 of the piston-cylinder variety connected between frame 11 and first and second crank arms 58, 59 of first and second force arm 43, 44. As shown in FIGS. 4 and 5, second actuator 61 includes a cylinder 63 and retractable and extendable rod 64. The interior end of rod 64 located in the cylinder 63 is connected to a piston 65. Piston 65 is positioned for reciprocal movement in cylinder 63 upon introduction and release of hydraulic fluid through first and second fluid ports 66, 67 located forward and rearward ends of cylinder 63. A boss 69 connected to the forward end of cylinder 63 pivotally connects it to the diagonal strut 20B. The outer end of rod 64 is equipped with a fitting 70 pivotally connected to the second crank arm 59. As shown in FIG. 5, a pin or bolt 71 passes through the fitting 70 and through crank arm 59, and is secured with a cotter pin 72. Retraction of the rod 64 relative to the cylinder 63 is accompanied by pivotal movement of force arm 44 in a direction to move the handle 56 upward or in the direction of the arrow 74 in FIG. 4. Extension of the rod 64 relative to the cylinder 63 is accompanied by downward movement of the handle 56 about pivot axis 54. First hydraulic actuator 60 is mounted in similar fashion to the second hydraulic actuator 61, having a cylinder 75 pivotally connected at one end to a diagonal frame strut 20A. A rod 76 is reciprocally mounted with respect to the cylinder 75 and is pivotally connected at the outer end to the first crank arm 58. Cylinders 75, 63 of hydraulic actuators 60, 61 are normally pressurized at the forward ends thereof to continually exert force in a direction to move the piston rods 76, 64 outward resulting in a downward force on the force arms 43, 44. The exercising person lifts the handles 55, 56 against this force to an upper limit, and then gently lets the handles down. As the exerciser is moving the handles 55, 56 upward, the pistons inside the cylinders 75, 63 are moved against the force being exerted inside the cylinder. When the handles are let down, the pistons move in the same direction as the hydraulic force exerted in the cylinders 75, 63.

Figures 6, 6A, 6B, 9:
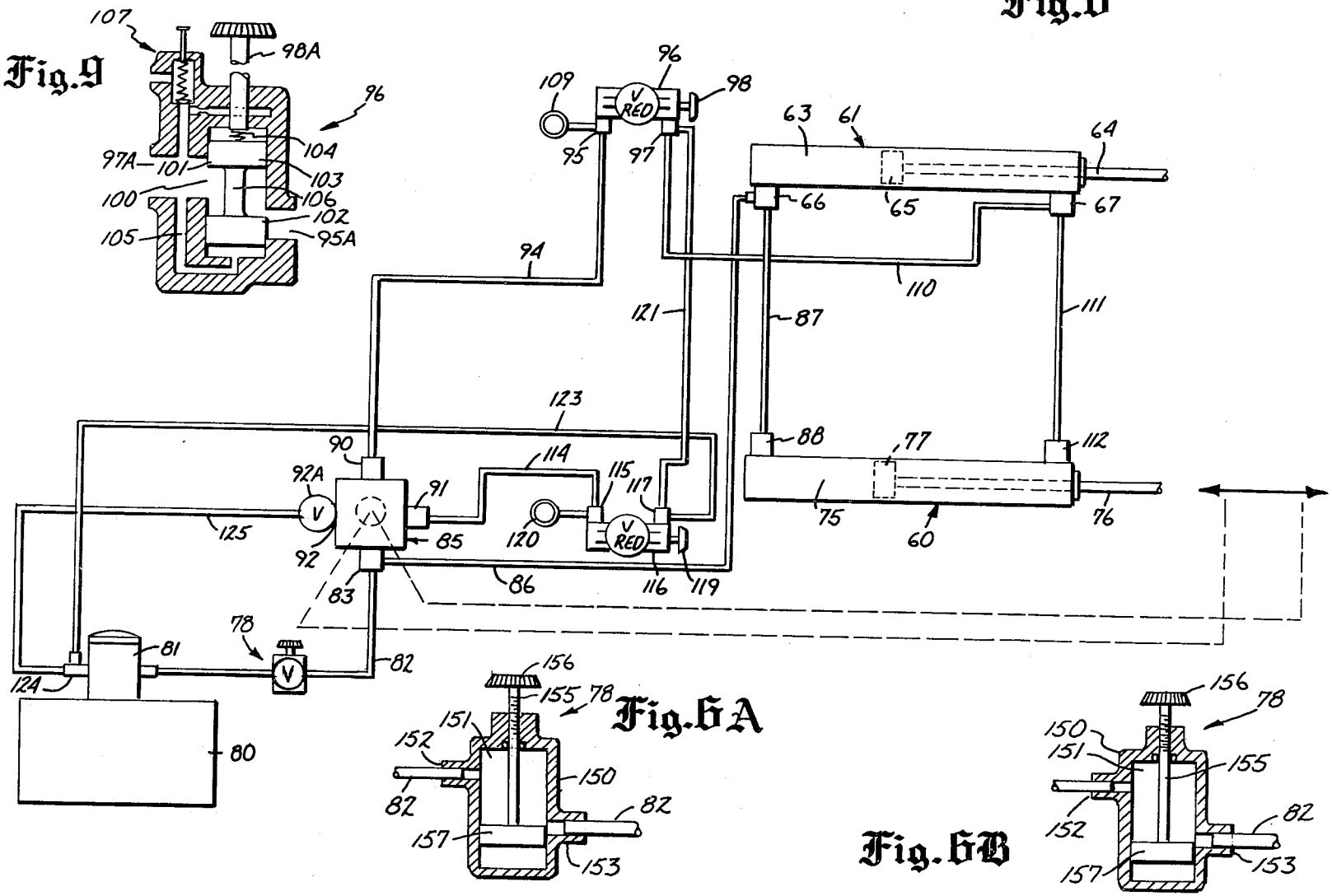
FIG. 6 is a diagrammatic view of the hydraulic motor assembly of the exercising device of FIG. 1.
FIG. 6A is an enlarged sectional view of the flow control valve shown in FIG. 6 and adjusted to a first position.
FIG. 6B is an enlarged sectional view of the flow control valve shown in FIG. 6 and adjusted to a second position.
FIG. 9 is a sectional view of a relief valve shown in the hydraulic circuit of FIG. 6.

The hydraulic fluid system for providing hydraulic fluid under pressure to actuators 60, 61 is illustrated in FIG. 6. A reservoir 80 stores hydraulic fluid for delivery by a hydraulic fluid pump 81 that pumps hydraulic fluid through a first fluid line or pump delivery line 82 to the inlet fitting 83 of a selector or distribution valve 85. A flow control valve 78 is interposed in the line 82 to control the volume of hydraulic fluid delivered through the delivery line 82. Pump 81 is adapted to deliver hydraulic fluid through the pump delivery line 82 at a first pressure P1 which is variable according to the adjustment of flow control valve 78. A second fluid line or high pressure hydraulic fluid line 86 extends from inlet fitting 83 of distribution valve 85 to the first or forward fluid port 66 of second hydraulic cylinder 63. As there is no pressure reduction at inlet fitting 83 of distribution valve 85, the pressure of fluid carried by high pressure line 86 is at the first pressure P1. A third fluid line or pressure equalization line 87 connects the first port 66 of second cylinder 63 to first port 88 open to the forward or pressure end of first cylinder 75. Fluid pressure in the forward or high pressure ends of the first and second cylinders 75, 63 is established and maintained at pressure P1 through the fluid lines 82, 86 and 87.

Distribution valve 85 has a first fluid outlet 90 and a second fluid outlet 91. As will be more fully described, distribution valve 85 has a switch operative to permit flow of hydraulic fluid through only one outlet at a time to the exclusion of the other. A fourth fluid line or outlet line 94 extends from the first outlet 90 of distribution valve 85 to the intake fitting 95 of a first pressure reduction valve 96. Pressure reduction valve 96 has an outlet 97 and is operative to reduce the hydraulic pressure between inlet 95 and outlet 97 whereby hydraulic pressure provided at outlet 97 is at a second pressure P2 which is lower than the first pressure P1. A control knob 98 is usable to vary the amount of pressure reduction provided by valve 96 and thus to vary the value of the second pressure P2. Pressure reduction valve 96 can be any suitable variety, for example, like the sliding spool valve depicted schematically in FIG. 9. The inlet passage 95A leads to a chamber 100 wherein a sliding spool 101 is located. Sliding spool 101 has a lower land 102 and an upper land 103 connected by a neck 106. A compression spring 104 operates on the upper land 103. There is a pressure drop at the restricted opening provided between lower land 102 and inlet passage 95A. The reduced pressure at outlet passage 97A acts on the lower land 102 of spool 101 through a channel 105. If the reduced pressure rises above the preselected value, it acts on the lower land 102 to move the spool 101 upwardly and further restrict the passage at inlet port 95A. Control knob 98 controls the tension exerted by spring 104. Relief valve 107 provides a drain from outlet port 97A. A first pressure gauge 109 is provided to measure the difference between the pressures at the inlet fitting 95 and the outlet fitting 97.

A fifth hydraulic fluid line comprised as a low pressure fluid line 110 extends from the outlet 97 of first pressure reduction valve 96 to a second or rearward fluid port 67 located at the second or rearward end of second cylinder 63, and can carry hydraulic fluid at the second pressure P2. A sixth hydraulic fluid line comprised as a second equalization line 111 extends from the fluid port 67 on cylinder 63 to the second fluid port 112 located at the second or rearward end of first cylinder 75. Hydraulic fluid under the second pressure P2 can be introduced into the second or rearward ends of the first and second cylinders 75, 63 from first pressure reduction valve 96 through the low pressure hydraulic fluid line 110 and second equalization line 111.

The second outlet 91 of reduction valve 85 is connected to one end of a seventh hydraulic fluid line comprised as a second distribution valve outlet line 114 connected at its opposite end to the inlet fitting 115 of a second pressure reduction valve 116. Second pressure reduction valve 116 has an outlet 117 and is operative to reduce the hydraulic pressure between inlet 115 and outlet 117 whereby hydraulic pressure is provided at outlet 117 at a third pressure P3 which is lower than the first pressure P1. Second pressure reduction valve 116 can be constructed in like manner to the first pressure reduction valve 96 and has a control knob 119 to control the amount of pressure reduction provided. A second pressure gauge 120 is effective to measure the pressure drop between inlet 115 and outlet 117. Outlet fitting 117 of pressure reduction valve 116 is connected to one end of an eighth hydraulic fluid line comprised as a connecting line 121. Connecting line 121 connects the outlet fitting 117 of second pressure reduction valve 116 to the outlet fitting 97 of first pressure reduction valve 96 to effectively connect the outlet 117 of second pressure reduction valve 116 to the low pressure hydraulic fluid delivery line 110 whereby hydraulic fluid under the third pressure P3 can be delivered to the low pressure ends of the first and second hydraulic cylinders 75, 63. Distribution valve 85 causes only one of the first and second pressure reduction valves 96, 116 to be operative at a time whereby hydraulic fluid under the second pressure P2 or under the third pressure P3 is delivered through the pressure delivery line 110 to the low pressure ends of the first and second hydraulic cylinders 75, 63.

A ninth hydraulic fluid line comprised as a reduction valve drain line 123 extends from the outlet fitting 117 of second hydraulic pressure reduction valve 116 to the inlet 124 of hydraulic pump 81. Through the connecting line 121, the drain line 123 is effective as a drain line for both the outlet 117 of second pressure reduction valve 116.

Distribution valve drain outlet 92 is equipped with a pressure relief valve 92A set to open when the pressure in the distribution valve 85 exceeds a preselected high pressure limit. Drain outlet 92 is connected to a tenth hydraulic fluid line comprised as a distribution valve drain line 125. Distribution drain valve line 125 extends from the drain outlet 92 of distribution valve 85 to the inlet 124 of hydraulic pump 81.

Figure 3:
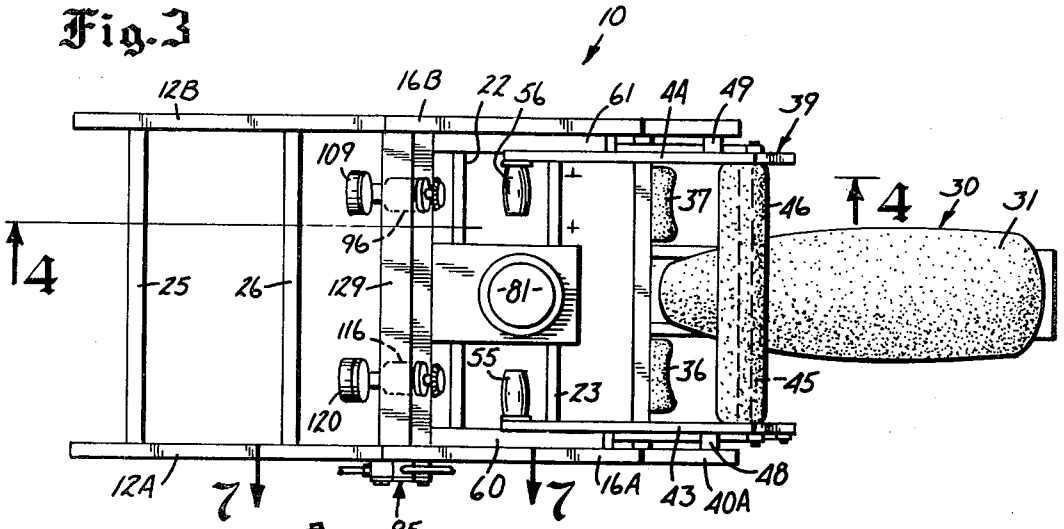
FIG. 3 is a top plan view of the device of FIG. 1.

Referring to FIGS. 1 through 3, distribution valve 85 is mounted on a mounting plate 126 attached to intermediate horizontal side frame member 17. Distribution valve is fixed to plate 126 by suitable bolts 127 or other suitable means. Hydraulic fluid reservoir 80 rests on the lower transverse frame brace members 22, 23, and pump 81 is situated on the reservoir 80.

A housing 129 extends across frame 11 being attached to the upper side frame members 16A, 16B. The first pressure reduction valve 96 is mounted in the housing 129 toward one side of frame 11, and the second pressure reduction valve 116 is mounted in the housing 120 toward the other side of the frame 11. Control knobs 98, 119 of the first and second pressure reduction valves respectively are readily accessible by an exercising person situated on seat 30. Flow control valve 78 can be mounted on longitudinal lower frame member 18.

As shown in FIGS. 7, 8, and 8A, distribution valve 85 includes a switch assembly to selectively direct hydraulic fluid under first pressure P1 through either the first valve outlet 90 or a second valve outlet 91 responsive to pivotal positioning of the handle bar assembly 39. A cylindrical valving element 130 is rotatably assembled in the housing of valve 85. Valving element 130 has fluid passages comprised as a first fluid passage 131 extending diametrically through the valving element 130, and a second fluid passage 132 extended in perpendicular relationship from the center of first passage 131 to the outer surface of valving element 130 forming a T-shaped fluid passage in valve element 130. As shown in FIG. 8A, in a first position or first mold, valving element 130 is positioned such that fluid passage 131 is open to inlet passage 83A of inlet 83 and the outlet passage 90A of first outlet 90. Second fluid passage 132 is open to the drain outlet 92. It may be seen that valving element 130 is rotatable 90 degrees in a clockwise direction as viewed in FIG. 8A to an orientation with the first fluid passages disposed between the second outlet port 91A of second outlet 91 and the drain outlet 92, with the second fluid passage 132 in communication with the inlet port 83A. In this orientation, hydraulic fluid enters the inlet port 83A and the second fluid passage 132 and is directed to the second outlet port 91A through a leg of the first fluid passage 131. Excess hydraulic fluid producing a pressure above the preselected high pressure limit is directed through the other leg of the first passage 131 and through the release valve 92A associated with the drain outlet 92.

A valve arm 134 is mounted exteriorly of distribution valve 85 and is connected at one end to valve element 130 for rotation thereof between the first and second modes. The opposite end of valve arm 134 has an outwardly extended pin 135 for engagement in switching the valve element between positions.

An elongate connecting link 136 connects handle bar assembly 39 to valve arm 134 of distribution valve 85. An upper end of link 136 is pivotally connected at 137 to the outer end of first crank arm 58 extending from the first force arm 43. The opposite end of link 136 has a closed-ended slot 138 engaging the actuating pin 135 of valve arm 134. Slot 138 is formed by a rod 140 disposed in spaced parallel relationship to the extreme end of link 136 and connected thereto by interior plate 141 and end plate 142 thus to form the slot 138. Actuating pin 135 rides in slot 138 between the end of link 136 and the rod 140. The end of link 136 is moved back and forth by movement of the force arms 43, 44 of handle bar assembly 39. When the force arms are lifted, the link 136 is moved from left to right as shown in FIG. 8 to a point where actuating pin 135 is engaged by interior plate 141. This moves the actuating pin 135 and valve lever 134 to the right or pivoted in a clockwise direction as viewed in FIG. 8 to the second mode position of FIG. 7. At this point, the force arms are at their extreme upper position and the let down phase of the routine is commenced. While the force arms are let down by the exercising person, the connecting link 136 moves from right to left as viewed in FIG. 7 to a point where the actuating pin 135 of valve arm 134 is engaged by the end plate 142 and is moved from the second position back to the first position. In the first position, the distribution valve 85 is set to direct hydraulic fluid under pressure P1 through the first outlet 90 and to the first pressure reduction valve 96. When the valve arm 125 is moved to the second position as shown in FIG. 7, distribution valve 85 is set to deliver hydraulic fluid under pressure through the second outlet 91 and to the second pressure reduction valve 116.

Regulation of flow control valve 78 regulates the volume of flow of hydraulic fluid and consequently the speed of movement of the pistons in cylinder assemblies 60, 61. This influences the speed at which the handles 36, 37 can be lifted and the speed at which they will move downwardly when resistance is not offered by the exercising person, while the pressure reduction valves 96, 116 determine the amount of force applied at the handles. A suitable flow control valve is illustrated in FIGS. 6A and 6B wherein valve 78 has a housing 150 defining a valve chamber 151. Housing 150 has a fluid inlet 152 and a fluid outlet 153 longitudinally displaced from the inlet 152. A valving element includes a valve stem 155 having an externally threaded portion in engagement with an internally threaded stem opening and manually rotatable by means of a valve handle 156 connected to the end of the stem 155. A valve spool 157 is fixed to the opposite end of stem 155. Valve spool 157 is movable in varying degrees of blocking relationship to the outlet 153 to restrict the volume of flow moving through the valve 78. In FIG. 6A, valve spool 157 is shown in blocking relationship to a relatively large portion of the outlet 153 whereby a lower volume of fluid is permitted to pass. Upon rotation of the valve stem 155, spool 157 is movable to a position like that of FIG. 6B wherein valve spool 157 blocks a relatively small portion of the outlet 153 and a greater volume of fluid is permitted to pass through the valve 78.

When valve 78 is adjusted to permit passage of a low volume of fluid, movement of the pistons 77, 65 in cylinders 75, 63 is relatively slower. This places a limit upon the speed at which the exercising person can lift the handles during the lift phase. If the exercising person tries to lift the handles faster than is permitted by the fluid flow in the system, he will encounter a resistance substantially larger than that afforded by the pressure drop caused by the reduction valves 96, 116. During the let down phase, movement will be accordingly slower. When the valve 78 is adjusted to permit passage of a higher volume of fluid, movement of the pistons 77, 65 and cylinders 75, 63 is relatively faster. During the lifting phase, the exercising person is able to lift the handles at a relatively faster speed. Likewise, during the let down phase, these unresisted handles would come down somewhat faster and, under the resistance of the exercising person, the exercising person can let the handles down at a speed under his control. In either the case of the high volume or low volume flow, the force resistance offered by the handles is controllable by the pressure drop at the pressure reduction valves 96, 116.

In use of exercise device 10, an exercising person 144 sits on seat 31 with knees in engagement with kneepads 36, 37. Flow control valve is adjusted to provide a first pressure P1 at an approximate desired flow rate. First pressure reduction valve 96 is adjusted through control knob 98 to provide a second output pressure P2. Second pressure reduction valve 116 is adjusted through control knob 119 to provide a third output pressure P3. Output pressures P2, P3 can be equal but preferably third pressure P3 is lower than second pressure P2 whereby the pressure difference on the pistons 77, 76 of the cylinders of actuators 60, 61 is greater when the distribution valve 85 is positioned to provide pressure output through the second reduction valve 116.

In commencing the exercise routine, the exercising person 144 grasps the handles 55, 56 connected to force arms 43, 44. Hydraulic pump 81 is operative to deliver hydraulic fluid under first pressure P1 to the pressure ends or first ends of the hydraulic cylinders 75, 63 of actuators 60, 61. Relief valve 92A of distribution valve 83 controls the hydraulic pressure delivered through the high pressure line 86 at the first pressure P1. Hydraulic fluid distribution valve 85 is set in the first position as shown in FIG. 8 whereby fluid is directed through the first outlet 90 and through the first outlet line 94 to the first pressure reduction valve 96. Fluid delivered at the outlet 97 of first pressure reduction valve 96 is at the second pressure P2 and is delivered to the low pressure end of the cylinders 75, 63 through the low pressure line 110 and equalization line 111. The pressure experienced by the pistons 77, 65 in the cylinders 75, 63 is the difference of the first and second pressures, P1 minus P2. This pressure difference acts to push the rods 76, 64 outwardly against the crank arms 58, 59 of handle bar assembly 39. This force tends to cause a downwardly force to be exerted on the handles 55, 56. The exercising person lifts the handles 55, 56 upwardly in the direction of the arrow 145 in FIG. 1 against the force exerted by the hydraulic actuators. This movement simulates the lifting of a weight. As the handles are lifted, the end of connecting link 136 rides along the actuating pin 135 of distribution valve arm 134 until the interior plate 141 contacts the actuating pin 135. Further movement of the connecting link 136 moves the actuating pin 135 to move the valve arm 134 from the position shown in FIG. 8 to the second position shown in FIG. 7. At this point, the handles 55, 56 are at the upward extreme limit of movement. While the exercising person is lifting the handles 55, 56 against the force exerted by actuators 60, 61, the actuator pistons 77, 65 move in the cylinders 75, 63 and displace hydraulic fluid located therein. At the upper limit of movement of the handles 55, 56, pressure distribution valve 85 is switched to the second position wherein hydraulic fluid under pressure is directed through the second outlet 91, the second outlet line 114 to the second pressure reduction valve 116. Second pressure reduction valve 116 delivers hydraulic fluid under third pressure P3 through the outlet 117, connecting line 121, and low pressure line 110 to the low pressure ends or second ends of the cylinders 75, 63. The pressure difference experienced on the pistons 77, 65 located in the cylinders 75, 63 is now the difference between the first pressure P1 and the third pressure P3. If the pressure P3 is lower than the pressure P2, the force exerted by the rods 76, 64 is greater. During this phase of the exercise routine, the exercising person 144 lets down the handles 55, 56 as though letting a weight down. However, the simulated weight during the let down phase is greater than the simulated weight during the extension phase due to the increased pressure difference on the actuator pistons 77, 65. Nonetheless, the exercising person can accommodate this as he is able to sustain a greater force under let down or retraction than during the extension phase of the exercise routine. During the retraction phase, the connecting link 136 is moved so that the actuator pin 135 of distribution valve arm 134 rides along slot 138 towards the end plate 142. At the point the actuator pin 135 meets the end plate 142, it is moved by end plate 142 from the second position shown in FIG. 7 to the first position shown in FIG. 8. At this point, the handles 55, 56 and respective force arms 43, 44 are at the lowermost limit of travel. Also at this point, distribution valve 85 is switched so that hydraulic fluid is again delivered through the first outlet 90 and to the first pressure reduction valve 96. The sequence is then repeated. Each time the exercising person lifts the handles 55, 56, the simulated weight offered by the actuators 60, 61 is less than during the retraction phase. During each exercise sequence, pressure distribution valve 85 is switched back and forth between providing hydraulic fluid under pressure to the first pressure reduction valve 96 and the second pressure reduction valve 116. The beneficial effects of the exercise routine are increased as the exercising person is able to and in fact does exert a greater effort during the retraction phase of the sequence than during the extension phase.

The speed at which the handles 55, 56 can be moved upward, and the maximum downward speed are influenced by adjustment of flow control valve 78.

While exercise device 10 has been shown to be of a configuration to accommodate an exercising person sitting on a seat and lifting a simulated weight from approximately the position of the waist up, it is apparent that arrangement of the force arms and actuators could be altered to simulate other forms of weight lifting exercise such as lifting over the head, pressing weights from the chest, leg press exercises, and the like. Further, while exercise device 10 has been shown and described equipped with a hydraulic motor assembly to provide reaction force to be opposed by the exercising person, it is apparent that other fluid operated assembly could be effectively employed, whether of the gas or liquid variety.

The embodiments of the invention in which an exclusive property or privilege is claimed are defined as follows:

1. An exercise device of the type wherein an exercising person works against a force occasioned by a pressure difference between ends of a hydraulic actuator, comprising:

frame means;

a reaction bar engageable by an exercising person for sequential movement with respect to the frame means in a first direction and in a second direction generally opposite to the first direction;

fluid operated means including a first hydraulic actuator of the type having a housing defining a chamber, a piston movably located in the chamber, and a rod fixed to the piston and extendible and retractable with respect to the housing, said hydraulic actuator being operably connected between the frame means and the reaction bar to exert hydraulic force on the reaction bar;

said housing and chamber having a high pressure end and a low pressure end whereby the piston tends to move toward the low pressure end to tend to move the reaction bar in the second of said directions;

a source of hydraulic fluid under pressure;

an adjustable flow control valve with a valve inlet connected to the source of hydraulic fluid under pressure and a valve outlet connected to the high pressure end of the hydraulic actuator housing;

a first adjustable pressure reduction valve having a valve inlet connected to the valve outlet of the flow control valve, and a valve outlet connected to the low pressure end of the housing whereby the pressure difference between the high pressure end and the low pressure end of the housing provides a force on the reaction bar tending to move it in said second direction and whereby the exercising person exerts manual force on the reaction bar opposed to the force exerted upon the reaction bar by the hydraulic actuator to overcome the force to move the reaction bar in the first direction and then resist the force while permitting the movement of the reaction bar in the second direction.

2. The exercising device of claim 1 wherein: said reaction bar has a first limit of travel in the first direction and a second limit of travel in the second direction, and including means to change the value of the second pressure when the reaction bar reaches a first limit of travel and when the reaction bar reaches the second limit of travel.

3. The exercising device of claim 1 including: a second adjustable pressure reduction valve having a valve inlet connected to the valve outlet of the flow control valve, and having a valve outlet connected to the low pressure end of the actuator housing, switch means associated with the flow control valve of outlet to divert flow of hydraulic fluid between the first pressure reduction valve and the second pressure reduction valve, said reaction bar having a first limit of travel in the first direction and a second limit of travel in the second direction, said reaction bar engageable with the switch means at the first limit of travel to actuate the switch means to divert hydraulic fluid flow to the second pressure reduction valve, and engageable with the switch means at the second limit of travel to actuate the switch means to divert hydraulic fluid flow to the first pressure reduction valve.

4. The exercise device of claim 1 wherein: said reaction bar is pivotally connected to the frame and has a first limit of travel in the first direction and a second limit of travel in the second direction, said fluid operated means adapted to selectively provide a first hydraulic pressure difference and a second hydraulic pressure difference for exertion of force on the reaction bar, switch means associated with the fluid operated means to switch between the first and second pressure differences, means on the reaction bar for engagement of the switch means at the second limit of travel for switching from the second pressure difference to the first pressure difference and for engagement of the switch means at the first limit of travel for switching from the first pressure difference to the second pressure difference.

5. The exercise device of claim 4 wherein: the force exerted on the reaction bar under the influence of the second pressure difference is greater than the force exerted on the reaction bar under the influence of the first pressure difference.

6. The exercise device of claim 1 wherein: said reaction bar includes first and second parallel force arms each pivotally connected at one end to the frame means and having outer ends pivotally movable in said first and second directions with respect to the frame means, said outer ends having handles adapted to be grasped by an exercising person.

7. The exercise device of claim 6 including: a transverse bar connected between the first and second force arms proximate the ends pivotally connected to the frame means for support of the arms of an exercising person when grasping the handles.

8. The claim and exercise device of claim 6 including: a second hydraulic actuator operably connected between the frame means and the reaction bar.

9. The exercise device of claim 8 wherein: the first and second force arms are mounted on the frame means for pivotal movement about a common axis.

10. The exercise device of claim 9 including: seat means connected to the frame means proximate the transverse bar for support of an exercising person.

* * * * *